US005305813A

United States Patent [19]

Poole

[11] Patent Number: 5,305,813

[45] Date of Patent: Apr. 26, 1994

[54] WINDOW BLINDS

[76] Inventor: Philip J. Poole, 13 Westfield, Lightcliffe, Halifax, West Yorkshire, HX3 8AS, England

[21] Appl. No.: 659,357

[22] PCT Filed: Aug. 30, 1989

[86] PCT No.: PCT/GB89/01005

§ 371 Date: Mar. 18, 1991

§ 102(e) Date: Mar. 18, 1991

[87] PCT Pub. No.: WO90/02240

PCT Pub. Date: Mar. 8, 1990

[30] Foreign Application Priority Data

Aug. 31, 1988 [GB] United Kingdom ..... 8820569

[51] Int. Cl.[5] ..... E06B 3/12

[52] U.S. Cl. ..... 160/236; 428/225; 428/229; 428/257; 428/258; 428/259; 428/288; 428/296; 428/373; 139/420 R

[58] Field of Search ..... 428/229, 258, 259, 288, 428/373, 296, 257; 160/236; 139/420 A, 420 B, 420 R

[56] References Cited

U.S. PATENT DOCUMENTS

| | | | |
|---|---|---|---|
| 3,508,990 | 4/1970 | Marzocchi | 156/166 |
| 3,620,892 | 11/1971 | Winckhofer | 428/197 |
| 3,645,819 | 2/1972 | Fuji et al. | 156/148 |
| 3,823,885 | 7/1974 | De Schulthess | 242/18 A |
| 3,894,387 | 7/1975 | Boisvert | 57/77.4 |
| 3,959,055 | 5/1976 | Slanik | 156/167 |
| 4,724,183 | 2/1988 | Heiman | 428/259 |
| 4,857,379 | 8/1989 | Plöntges et al. | 428/259 |

FOREIGN PATENT DOCUMENTS

| | | | |
|---|---|---|---|
| 40717/78 | 10/1978 | Australia | D04H 3/12 |
| 32078/84 | 8/1984 | Australia | E06B 9/36 |
| 0123740 | 4/1983 | European Pat. Off. | D02G 3/40 |
| 3514217A1 | 4/1985 | Fed. Rep. of Germany | D02G 3/04 |
| 2146521 | 7/1971 | France | D04C 1/100 |
| 146839 | 7/1986 | Japan . | |
| 1108132 | 4/1968 | United Kingdom . | |
| 2020335 | 3/1979 | United Kingdom | D02G 3/02 |

*Primary Examiner*—James J. Bell
*Attorney, Agent, or Firm*—W. Thad Adams, III

[57] ABSTRACT

A fabric window blind is made of a fabric constructed of yarns. The fabric window blind is characterized by dimensional stability in first, second and third dimensions wherein the window blind is resistant to cupping and twisting. The window blind fabric is formed of a high temperature fiber component constituted within yarns of the fabric and a thermoplastic low melt fiber component constituted within yarns of the fabric. The high temperature fibers and the low melt fibers of the fabric are bonded to each other by heating the fabric to a point above the melting point of the low melt fiber and below the temperature-induced degradation point of the high melt fiber. The melting point of the low melt fiber is at least 110 degrees centigrade.

13 Claims, No Drawings

WINDOW BLINDS

This application is a PCT application.

This invention relates to window blinds and to a method of making window blinds. The invention relates in particular to window blinds comprising yarn-based fabrics which are given a heat treatment to improve their shape stability, the heat treatment melting a first component but not a second component.

Window blind fabrics require to be shape stable. This is difficult to achieve. It is particularly difficult to achieve with louvre blinds, in which the blind comprises a number of narrow vertical strips of fabric. If the fabric lacks stability the strips of fabric will twist or curve. Shape instability of window blind fabrics is aided by the high temperatures adjacent to windows. For this reason window blind fabrics, in particular louvre blind fabrics, are generally coated, to stiffen them, typically using polyvinyl chloride or polyvinyl alcohol. The result is a fabric which feels like a synthetic polymer rather than a textile product. Futhermore, the coating process is expensive, the capital outlay on a production coating machine being very large. Moreover, the process is not always wholly successful; the blinds frequently have to be weighted at the bottom to additionally hinder twisting or curving.

Conventional blind fabrics of the type described are not readily cleanable; they cannot be machine washed or dry cleaned. The synthetic coating may degrade in the light conditions, causing yellowing.

According to the present invention there is provided a window blind comprising a fabric, wherein the fabric comprises a monofilament yarn and/or a yarn made up of a plurality of staple fibres or filaments, said yarn providing a low melt component of the fabric, which low melt component melts at a temperature of at least about 1100°C., the fabric further comprising a high melt component which is stable against melting or degradation at the temperature at which the low melt component melts, the fabric having been subjected to a temperature above the melting point of the low melt component but below the melting or degradation point of the high melt component, so as to cause the low melt component to adhere to the high melt component.

The fabrics of the window blinds in accordance with the invention are shape stable and stiff, relative to equivalent untreated fabrics, and resistant to humidity, but retain a textile feel rather then the feel of a synthetic polymer, which results from the present coating processes which are required with existing fabrics.

Fabrics used for window blinds of the invention are generally water washable under normal domestic or commercial conditions, without shrinkage or stretching. Boil washing may generally be carried out without damage to the fabrics.

To ensure the stability of the high melt component at the temperature at which the low melt component melts, the temperature at which the high melt component melts or otherwise degrades is preferably at least about 20° C. above the temperature at which the low melt component melts, more preferably at least about 50° C. higher.

Suitably, the temperature at which the low melt component melts is about 110° C. to about 210° C., preferably 130°C. to about 190°C., most preferably about 150° C. to about 180° C.

The low melt component in a window blind fabric in accordance with the invention may be comprised by a yarn constituted substantially entirely by the low melt component. Such a yarn may be made up of staple fibres of the low melt component, filaments of the low melt or be a monofilament thereof. Simalarly, the high melt component in the fabric may be a yarn composed substantially entirely of high melt fibres, filaments or a high melt monofilament. Yarns made up of a plurality of staple fibres or filaments are preferred. Preferably the fabric comprises a yarn which in itself has a low melt component and a high melt component.

In one embodiment the yarn for the fabric comprises a plurality of staple fibres or filaments in which the high melt component is present as a core and the low melt component is present as a sheath around the core. In another embodiment the low melt and high melt components are arranged with one on one side of the fibres or filaments which make up the yarn and the other on the other side of the fibres or filaments which make up the yarn. In another embodiment the yarn for the fabric is made up of a plurality of staple fibres or filaments of the low melt component and a plurality of staple fibres or filaments of the high melt component, the arrangement within the yarn preferably being substantially random.

A typical yarn in accordance with the invention will have about 20 to about 180 staple fibres or filaments per given cross-section. Suitably, the low melt component comprises about 10 to about 90 percent by weight of the yarn, preferably about 10 to about 60 percent, and most preferably about 20 to about 50 percent.

The low melt component could, for example, be polyvinyl chloride, polypropylene, polyamide, polyacetate, polyacrylic or polyester including partially oriented yield (POY) polyester, whereby an eventual fabric may shrink and densify on heat treatment. The high melt component could, for example, be polyacrylic, polyester, cotton, linen or wool.

The yarn for the fabric may be prepared in any available spinning or bulking process. Thus, the yarn may be produced, for example, by semi-worsted ring spinning (plain and fancy); cotton ring spinning; woollen ring spinning; worsted ring spinning; open end/break spinning/rotor spinning; paraffil wrap-yarn systems; hollow spindle systems; dreft spinning systems; and the Repco system.

A suitable fabric for use in a window blind in accordance with the invention, incorporating a yarn comprising a low melt component, may be made wholly from that yarn, or that yarn may be present as one of a number of yarns used in the fabric. For example, the warp or the weft only of a woven fabric may comprise such a yarn, and not all of the warp or weft need be constituted by such yarns. Preferably, however, substantially all of the yarn of the fabric comprises a low melt component. It has been found that when this is so, the fabric can simply be cut to shape, using, for example, a knife or scissors, or cold crush cutting, using a weighted roller carrying a blade, without fraying occurring at the edges. Of course, a heat cutting technique may be employed and this will cause melting and enhanced stability along the edges.

The fabric may comprise one or more low melt components, and one or more high melt components.

The fabric may be produced by any yarn-based method, for example weaving, warp laying, warp knitting or weft knitting. Weaving is preferred.

In accordance with a further aspect of the invention there is provided a method of making a window blind, the method comprising the steps of forming a fabric therefor from a monofilament yarn and/or a yarn made of a plurality of staple fibres or filaments, the yarn providing a low melt component of the fabric, which low melt component melts at a temperature of at least about 110° C., the fabric further comprising a high melt component which is stable against melting or degradation at the temperature at which the low melt component melts, the method comprising: forming the fabric from the yarn; subjecting the fabric to a temperature above the melting point of the low melt component but below the melting or degradation point of the high melt component, so as to cause the low melt component to adhere to the high melt component; and then subjecting the fabric to a temperature below the melting point of the low melt component. Generally, such a method will be applied to a full width of fabric, so that subsequent steps will be to cut a piece or pieces from the fabric and to locate the piece or pieces in the window blind hardware.

Optionally, a heat treatment is employed which may cause heat setting of the high melt component. Such a heat treatment may be a step additional to the heat treatment which melts the low melt component, or one step may cause both effects.

The heat treatment described above may be achieved by any of the available methods, for example by means of hot air, preferably stentoring, whereby fabric is passed over gas burners, or by means of hot liquids, for example water under high pressure, or by contacting the fabric with a hot object such as a hot roller (calendering), or by treatment with a hot vapour, for example, steam or an organic vapour.

Window blinds in accordance with the invention may, for example, be roller blinds or louvre blinds. The invention is particularly useful in the context of louvre blinds, where the demands on the narrow, vertical fabric strips, in particular in terms of their stability, are extreme.

Fabrics used for the window blinds of the invention can be porous or non-porous, the latter being achieved without the need for further treatment if a fine fabric structure is produced.

Fabrics used for the window blinds preferably include a flame resistant yarn, which may be a yarn of inherent fire retardant properties, but will preferably be a yarn which has been treated for flame retardancy prior to weaving. Suitable flame retardant yarns are flame retardant polyacrylic yarns (modacrylic), for example yarns sold under the Trade mark TEKLAN, and flame retardant pclyester yarns, for example yarns sold under the Trade Mark TREVIRA CS. Alternatively or additionally, the fabrics may be treated to increase their flame resistance/fire retardance after weaving.

The invention will now be further described, by way of example, with reference to the following Examples.

EXAMPLE 1

A differential melt fabric for window blinds was produced from the following blend of polyester fibres:

20% TREVIRA (Trade Mark) type 252 bi-component (core-sheath) polyester in 3 decitex 50 mm staple. The core of this material is of high melt polyester, and the sheath is of polyester which melts at about 150° C.; 80% standard polyester in 6.7 decitex 100 mm staple. This material has a melting point around 240° C.

(a) Fibre Preparation and Yarn Spinning

The fibres were blended together in loose fibre form an a blend bed which took it into an opening machine which started the first stage of the mixing or blending of the fibres. From the opening machine the first stage the blended fibres was fed into a cyclone blender which further mixed the fibres by means of gravity, centrifugal force and air currents.

The fibres at that stage were roughly mixed, but in no alignment to the axis of the web. By means of ducting and air currents, the roughly mixed fibres were fed into the hopper feed of the carding machine. This machine by means of pins mounted on different sized rollers, further blended the fibre types, while at the same time straightening them to some degree along the axis of the card sliver.

The card sliver containing the fibre blend was then put through three stages of drawing which further blended the two fibre types and further aligned them along the axis of the slivers. This was achieved by putting six slivers into each drawing machine and reducing the sliver weight by a factor of six giving a final blending of 216 mixings (6×6×6).

The final drawn sliver was fed into a ring spinning machine which further drew out the sliver during the spinning process. The drawn sliver was twisted into a yarn at this stage, and the resulting yarn was collected on a ring tube.

The yarn was wound from the ring tube on to a cone through an electronic clearer which took out faults and imperfections in the yarn after the spinning.

The yarn at this stage was a randomly blended mixture of the two components.

(b) Weaving

The differential melt yarn thus produced was woven across an air textured, standard polyester warp (high melt—240° C.), on a rapier weaving machine. The grey cloth on table details of the fabric are:

54 ends per inch of 420 decitex air-textured polyester warp;

26 picks per inch of 125 decitex differential mount fibre yarn as described above. Fabric width was 72.5 inches.

(c) Finishing

The fabric was fed into a pin stentor machine for heat treatment. The machine had seven bays and the temperature of each bay was 150° C. The fabric speed was 10 meters per minute and the fabric was treated at 150° C. for five minutes.

The appearance of the fabric had not changed and the handle of the fabric was still textile in character. The fabric had, however, become much firmer.

The full width fabric was slit into strips for vertical louvre blinds using heated cutters and was found to be fully stable when tested under a wide range of conditions, being very resistant to curving, cupping and twisting, even in high humidity and at high temperature.

The full width fabric was trimmed at the edges and tested for roller blind use and it too was found to be fully competent in meeting the requirements of that use.

In a further test the same material and the heat treatment was carried out at 180° C. The resulting fabric was also excellent, textile in handle but a stiffer fabric than that treated at 150° C.

FURTHER EXAMPLES

By similar methods the following heat-stabilised fabrics were produced. The heat treatments were carried out at 180° C., unless otherwise stated.

Standard polyester (high melt component)/polyvinyl chloride (low melt component)—75/25 percent wt—warp and weft. The resultant fabric was cuttable by scissors or a knife without causing fraying.

Standard polyester/polyvinyl chloride (low melt component) 75/25 percent wt weft only.

Standard polyester/polyvinvyl chloride (low melt component) 66/34 percent wt—warp and weft. The resultant fabric was cuttable by scissors or a knife without causing fraying.

Standard polyester/polyvinyl chloride—66/34 percent wt—weft only.

Standard polyester/polypropylene (low melt component)—75/25 percent wt—weft only.

Standard polyester/polypropylene—60/40 percent wt—weft only.

Standard polyester/low melt polyester—66/34 percent wt—weft only.

Polyester TREVIRA 252 (low melt component)-/polyester TREVIRA CS (flame retardant, high melt component) 72/28 percent wt—warp and weft.

This fabric was finished as described above, on a five bay stentor, at 190° C. The finished fabric was slit using a machine with heated slitters, to seal the edges. Samples of the slit fabric were tested by washing in a household washing machine, for ten cycles on a "fast coloureds" setting. No effect on the fabric stability, feel or appearance was measured of discernable. Further samples of this fabric were sent for testing for flame retardancy at a testing laboratory. They were tested to British Standard Part 2 Type C and were passed. Further samples were tested for flame retardancy using French Standard Afnor tests, and the pass classification was to the highest standard, that of M1.

All of the above examples resulted in the production of stable fabrics of textile rather than synthetic polymer character. The fabrics are water washable, in normal domestic equipment, at high temperatures.

I claim:

1. A fabric window blind comprising a woven or knitted fabric constructed of yarns, said fabric window blind being characterized by dimensional stability in first, second and third dimensions wherein the window blind is resistant to cupping and twisting, said window blind fabric comprising a high temperature fiber component constituted within yarns of the fabric and a thermoplastic low melt fiber component constituted within yarns of the fabric, said fabric having said high temperature fibers and said low melt fibers bonded to each other by heating said fabric to a point above the melting point of the low melt fiber and below the temperature-induced degradation point of the high melt fiber, the melting point of the low melt fiber being at least 110 degrees centigrade.

2. A fabric window blind according to claim 1, wherein said fabric yarns comprise a first yarn, said first yarn comprising said high temperature fiber component and said low melt fiber component.

3. A fabric window blind according to claim 2, wherein said first yarn comprises substantially the entire yarn of said fabric window blind.

4. A fabric window blind according to claim 1, wherein said fabric is a woven fabric having warp and filling yarns, the warp yarns comprised substantially completely of said high temperature component fibers, and the filling yarns comprised of said high temperature fiber component and said low melt fiber component.

5. A fabric window blind according to claim 1, wherein said fabric is a woven fabric having warp and filling yarns, the filling yarns comprised substantially completely of said high temperature component fibers, and the warp yarns comprised of said high temperature fiber component and said low melt fiber component.

6. A fabric window blind according to claim 1, wherein said low melt fiber component comprises polyvinyl chloride, polypropylene, polyamide, polyacetate, polyacrylic or polyester.

7. A fabric window blind according to claim 1, wherein said high temperature fiber comprises polyacrylic, polyester, cotton, linen or wool.

8. A fabric window blind according to claim 1, wherein said high temperature fiber comprises a high melt thermoplastic fiber.

9. A fabric window blind according to claim 1, wherein said high temperature fibers and said low melt fibers are staple fibers.

10. A fabric window blind according to claim 1, wherein said high temperature fibers and said low melt fibers are filament fibers.

11. A fabric window blind according to claim 1, wherein said fabric window blind is uncoated.

12. A fabric window blind according to claim 1, wherein said window blind comprises a louvre-type window blind.

13. A method of making a window blind, comprising the steps of:

(a) forming a fabric from a low melt yarn component which melts at a temperature of at least about 110 degrees C., and a high melt yarn component which is stable against melting or degradation at the temperature at which the low melt yarn component melts;

(b) subjecting the fabric to a temperature above the melting point of the low melt yarn component but below the melting or degradation point of the high melt yarn component, to cause the low melt yarn component to adhere to the high melt yarn component;

(c) subjecting the fabric to a temperature below the melting point of the low melt yarn component to set the low melt yarn component;

(d) stabilizing the high melt yarn component by applying heat thereto; and (e) assembling the fabric into a window blind construction using window blind hardware.

* * * * *